US005465977A

United States Patent [19]

Mann

[11] Patent Number: 5,465,977

[45] Date of Patent: Nov. 14, 1995

[54] ARCHERY TARGET STOP

[76] Inventor: Daniel Mann, 1719 Monroe St., Shelton, Wash. 98584

[21] Appl. No.: 231,279

[22] Filed: Apr. 22, 1994

[51] Int. Cl.[6] ..... F41J 3/00

[52] U.S. Cl. ..... 273/408; 273/403; 273/404

[58] Field of Search ..... 273/403, 404, 273/407, 408

[56] References Cited

U.S. PATENT DOCUMENTS

| | | | |
|---|---|---|---|
| 3,329,431 | 7/1967 | Roesner | 273/403 |
| 4,813,684 | 3/1989 | Bruno | 273/408 |
| 4,940,244 | 7/1990 | Batts | 273/403 |
| 5,290,042 | 3/1994 | Worley et al. | 273/408 |

FOREIGN PATENT DOCUMENTS

| | | | |
|---|---|---|---|
| 2932778 | 3/1981 | Germany | 273/404 |
| 545508 | 5/1942 | United Kingdom | 273/408 |

*Primary Examiner*—Mark S. Graham
*Attorney, Agent, or Firm*—Brian J. Coyne

[57] ABSTRACT

An archery target comprising a stack of carpet strips placed upon a base, with the side edges of the strips facing toward the archer. The strips are maintained under compressive force by a pair of flexible bands wrapped around front and rear portions of the stack and the base. The stack preferably includes alternating strips of light weight commercial grade, medium weight plush, and heavy weight plush carpet, which can be waste strips from carpet manufacture or installation. The compressive force is adjusted to permit arrows shot at the target to penetrate at least six inches, but not more than ten inches. The target includes caster wheels attached to the base for rolling the target from one location to another. The target is extremely durable even if it is left exposed to adverse weather conditions. A smaller, portable version of the target is also disclosed. The target presents a minimal hazard to wayward arrows, thereby minimizing damage to arrows.

5 Claims, 3 Drawing Sheets

ARCHERY TARGET STOP

BACKGROUND OF THE INVENTION

1. Field of the Invention

This invention relates to the field of archery targets, and in particular to free standing targets that include compressed strips or elements of penetrable material for arresting the flight of an arrow.

2. Description of the Prior Art

Prior art targets within the field of this invention include those disclosed in the following U.S. patents.

U.S. Pat. No. 4,940,244 to Batts disclosed a modular archery target body mounted between a pair of upright supports, suspended by a first rod and supported on a plurality of lower rods, which rods interconnect the upright supports. The target body was comprised of elongated modules of laminated, cellulosic, corrugated sheets. One end of each rod was fixed to one upright support, and the other end was adjustable for tightening and compressing the target body modules between the upright supports. In recognition of the fact that the modules located in a central portion of the target body receive the most arrow strikes and, consequently, the most wear, the target body could be disassembled for interchange of the peripherally disposed modules with the centrally-disposed modules of the target body.

U.S. Pat. No. 4,813,684 to Bruno disclosed an archery target for arrows comprising a stack of laterally extending strips of cardboard or similar porous, fibrous material with the side edges thereof facing toward the archer, the strips being compressed together within telescoping upper and lower frame sections. A clamp bar, which extended across the top of the upper frame section, had apertures at the opposite ends thereof for receiving the threaded free end portions of adjustment rods connected to the lower frame section. A hand nut having a hand grasp extension was threaded on each adjustment rod in bearing engagement against the clamp bar, whereby rotation of the hand nuts permitted increase or decrease in the compression of the strips against each other, thereby increasing or decreasing the penetration of an arrow into and between the edges of the strips. The frame was pivotally mounted on a stand so that it could be rotated to alternately place either the front or the back of the target facing the archer. The stand was supported by wheels or rollers for rolling of the target from one place to another.

U.S. Pat. No. 4,195,839 to Rodrigue disclosed an archery target comprising a base plate, a plurality of studs mounted on the base plate parallel to each other, a plurality of parallel rods embedded in a resilient foam rubber mattress, each rod having a pointed end facing in the direction from which arrows were to be shot and an opposite butt end for reversible insertion into a stud, and a peripheral outer cover lined with resilient material. The rods were made of plastic or other suitable material. When an arrow hit the target, the pointed arrow head was embedded between adjacent rods and its forward motion was halted by the friction of the rods. When the arrow was pulled out, the displaced rods came back to their original position under the compressive force exerted by the resilient material inside the outer cover.

U.S. Pat. No. 3,512,778 to Allen disclosed an archery target comprising vertically stacked strip inserts, the edge portions of the strips being positioned to form a target surface and to give it a honeycomb configuration. The inserts were comprised of successively alternated shorts strips and long strips of corrugated paper or paperboard glued in face-abutting relation to achieve an integral laminate form with grooved opposite ends. A rectangular frame, which was also composed of laminates of corrugated paper or paperboard, provided slide guides formed to interfit in the grooved ends of the inserts, whereby the inserts could be slidably inserted between and contained by the frame elements and similarly removed when damaged.

U.S. Pat. No. 3,329,431 to Roesner disclosed an archery target comprised of upper, middle and lower sections bound together under compression by a plurality of outer binding cords. Each of the sections included a plurality of long, flat, paper-wrapped packets each stuffed with excelsior and stacked together to form a rectangular assembly. A plurality of inner binding cords were wrapped around the center section packets to compressively bind them together to a greater density than the packets of the top and bottom sections.

U.S. Pat. No. 2,305,271 to Pearson disclosed an archery target embodying substantially concentric convolutes composed of a continuous layer of fabric and a continuous layer of straw positively united together, said layers being spirally wound to form a disk with a layer of fabric interposed between each layer of straw, each layer of fabric having an edge exposed at opposite sides edgewise to the flight of an arrow striking the target. In the manufacture of the target, the fabric was wound under tension and the strip carried the straw tightly compressed.

Targets such as those disclosed by Pearson, Roesner, Allen, Bruno, and Batts that employ organic materials, for example, straw, fabric, paper, cardboard, excelsior, or other cellulosic materials, were subject to deterioration from repeated arrow strikes as well as from adverse weather conditions. Although the target disclosed by Rodgrigue was relatively durable, each target required the fabrication of special components, such as rods, studs, and an outer cover, and failed to incorporate materials that would likely otherwise be wasted and go into landfills; compare, for instance, the target disclosed by Bruno, which could incorporate waste cardboard. The target disclosed by Bruno, however, suffers from still another disadvantage: the frame and stand thereof present a significant hazard for damage to a poorly aimed arrow. Avoidance of damage to the arrows is necessary in order to render participation in the sport of archery financially feasible for people of modest means. Carbon arrows present an additional problem not solved by the prior art: their shafts are more narrow than wood and aluminum arrows and, therefore, tend to penetrate entirely through targets rather easily. When carbon arrows are shot at the target disclosed and claimed herein, however, the carpet strips close in around the arrow shaft even if the arrow tip is larger than the shaft as in carbon arrows, and effectively prevent penetration beyond ten inches.

SUMMARY OF THE INVENTION

It is, therefore, an object of the invention to provide an archery target for arrows comprising a stack of horizontal carpet strips under compressive force, with the side edges thereof facing toward the archer, said strips being preferably waste materials from manufacture or installation of carpet.

It is an object of the invention to provide an archery target for arrows comprising a stack of horizontal carpet strips under compressive force, with the side edges thereof facing toward the archer, and compression thereof is maintained by narrow bands wrapped around front and rear portions thereof, thereby minimizing the chance that arrows shot at the target will be damaged.

It is an object of the invention to provide an archery target for arrows comprising a stack of horizontal carpet strips under compressive force, with the side edges thereof facing toward the archer, wherein the stack of carpet strips includes in alternating sequence strips of relatively light weight commercial grade carpet, carpet strips of medium weight plush carpet, and strips of heavy weight plush carpet.

It is an object of the invention to provide an archery target for arrows comprising a stack of horizontal carpet strips under compressive force, with the side edges thereof facing toward the archer, wherein the compressive force is adjusted so that arrows shot by an archer from an archery bow penetrate between the strips for a distance of not less than six, nor more than ten inches.

It is an object of the invention to provide an archery target for arrows comprising a stack of horizontal carpet strips under compressive force, with the side edges thereof facing toward the archer, a base, and a plurality of casters attached to the base for rolling of the target from one place to another.

It is an object of the invention to provide a durable archery target that is capable of absorbing and stopping carbon arrows.

Figure 1:
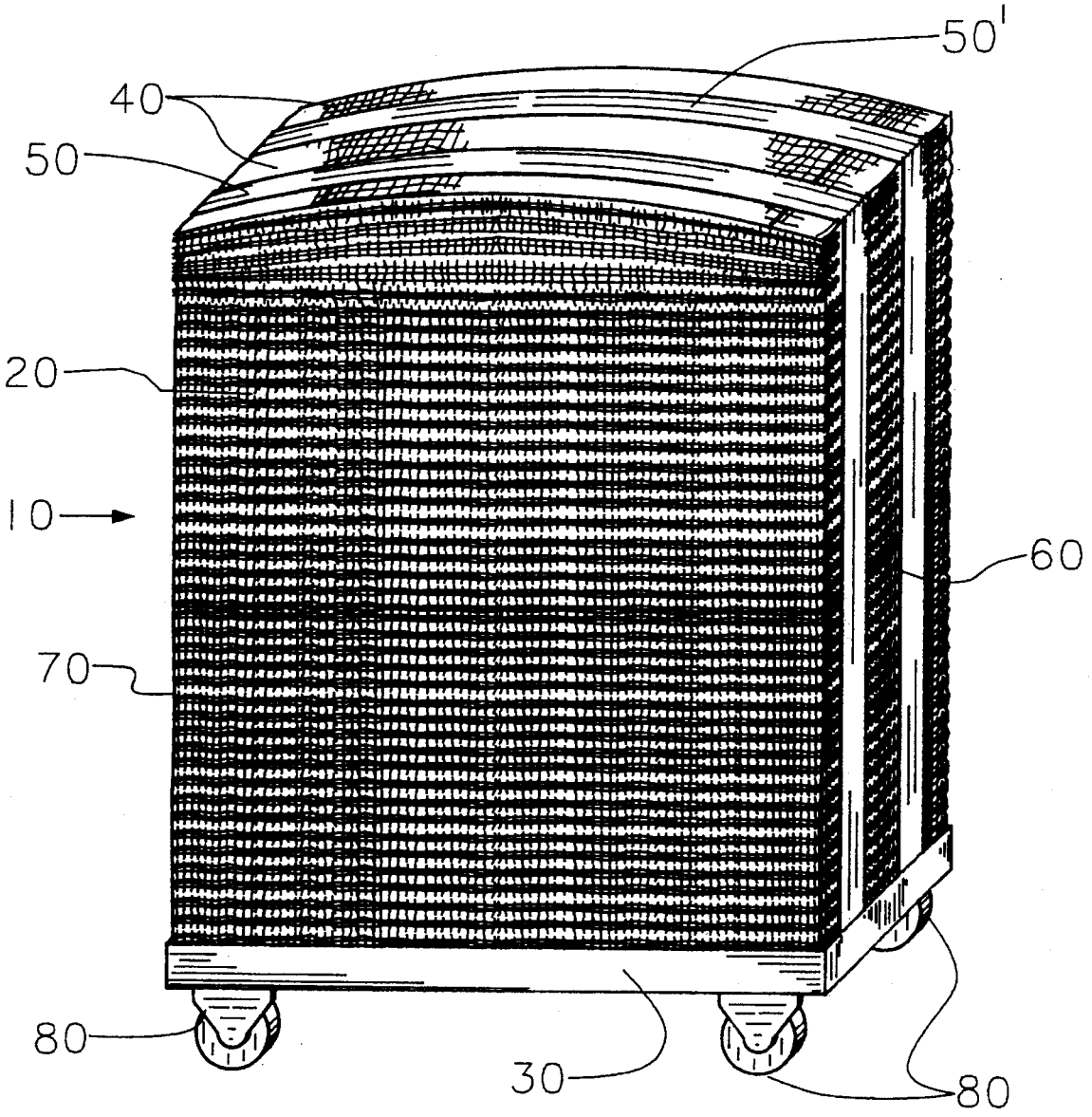
FIG. 1 is a frontal perspective view of the archery target of the present invention.

The terms "front" and "rear" as used herein refer to the near and far portions of the target as illustrated in FIG. 1, respectively.

DESCRIPTION OF THE PREFERRED EMBODIMENT

Figure 2:
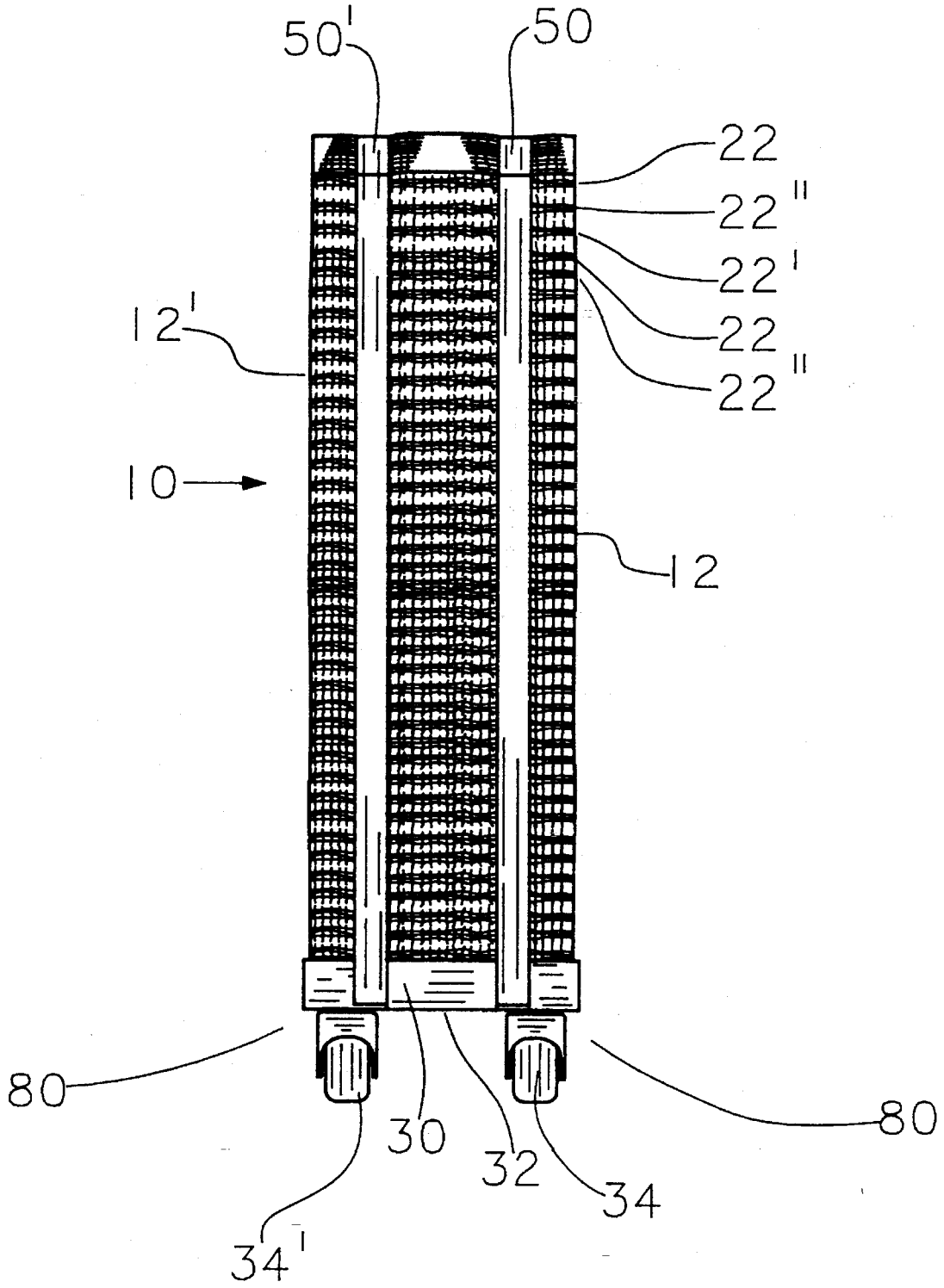
FIG. 2 is a side elevational view of the target.

An archery target in accordance with this invention, denoted generally by the numeral 10, includes a stack 20 of horizontal, rectangular strips of carpet placed upon a rectangular base 30. Referring to FIG. 2, it may be seen that the carpet strips are layered one upon another in alternating layers of low weight commercial grade carpet 22, medium weight plush carpet 22', and heavy weight commercial grade carpet 22". Preferably, the low weight commercial grade carpet 22 is 20 ounce, the medium weight plush carpet 22' is 40 ounce, and the heavy weight plush carpet 22" is 60 ounce, but other combinations of varying carpet weights can also be employed. Such carpet strips 22 are generally available at little or no cost as waste products of carpet manufacture and/or carpet installation, and their incorporation into archery targets prevents them from becoming a solid waste disposal problem.

Once the stack 20 is placed upon the base 30, a vertical compressive force is applied to the top 40 of the stack 20, for example by means of a hydraulic jack placed under the base, and a pair of narrow, flexible bands 50, 50' are wrapped around front and rear portions of the top 40, right side 60, left side 70 and base 30, respectively, and secured in position to maintain the compressive force on the carpet strips 22. To accommodate the bands 50, 50', a lower surface 32 of the base 30 includes front and rear slots 34, 34'. The bands are preferably made from a flexible, rustproof metal, steel for example, or from a flexible plastic. The base is preferably made from a strong, rigid plastic or ground contact pressure treated wood. A plurality of caster wheels 80 is attached to the base for rolling the target from one location to another.

Figure 3:
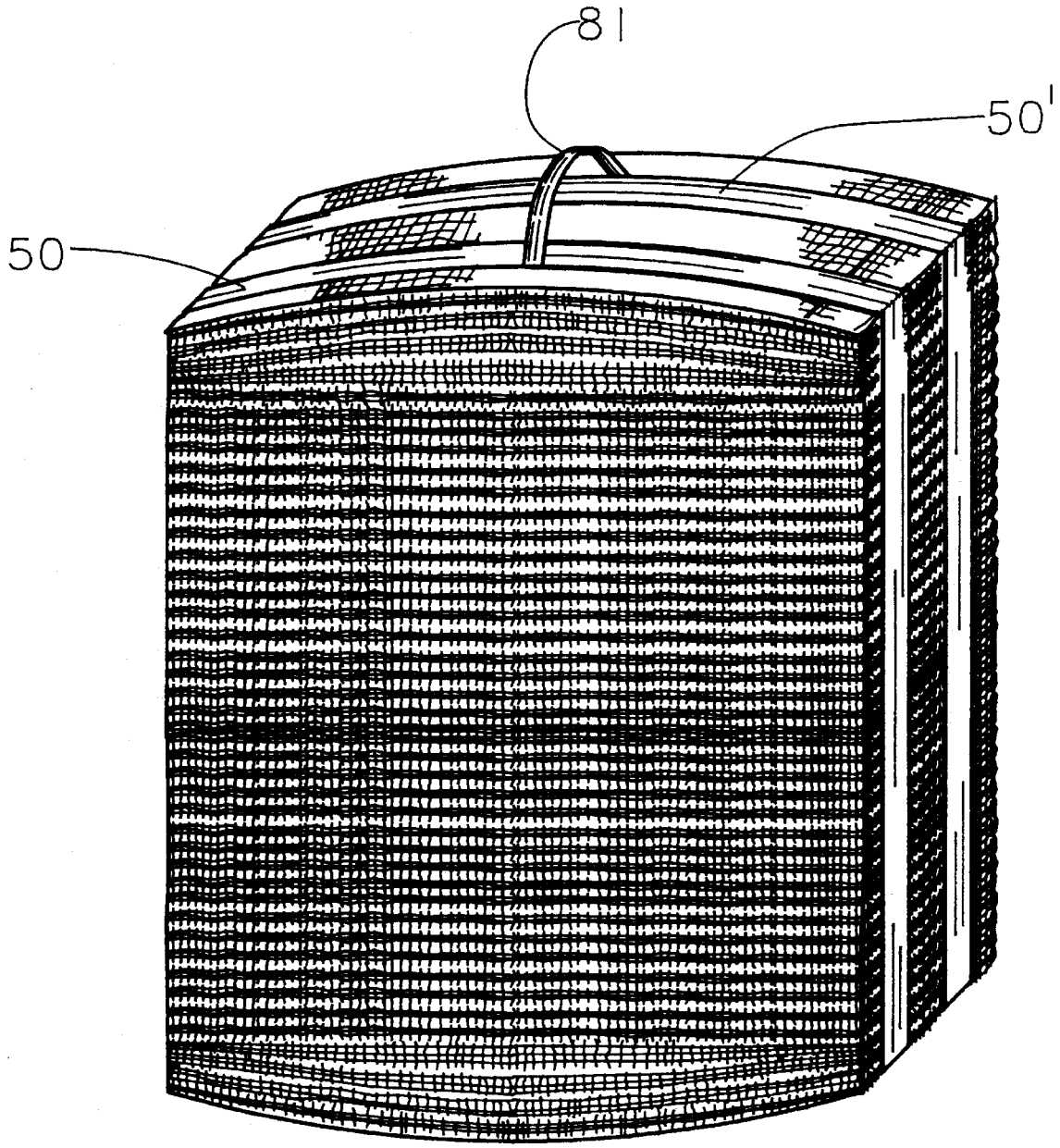
FIG. 3 is a frontal perspective view of a second, portable version of the archery target of the present invention.

An alternate embodiment of the invention is a second portable version illustrated in FIG. 3. For the portable version, suitable rectangular dimensions for the carpet strips 22 and base 30 are two feet wide by two feet high by eight inches deep. A handle 81 preferably made of nylon is attached to bands 50, 50' to facilitate carrying the target from place to place. A base can optionally be included but is preferably omitted in the portable version to minimize the weight of the target. Except for its diminished size, addition of the handle 81, and omission of wheels 80 and optionally of base 30, the construction of the portable is the same as that of the first version.

The present invention permits placement over the front and rear faces 12, 12' thereof of a plastic, burlap or paper target image, such as a bull's eye (not shown), which may be replaced as frequently as necessary without requiring any change or maintenance in the target 10 itself.

In view of the foregoing it will be seen that the several objects of the invention are achieved and other advantages obtained.

Although the foregoing includes a description of the best mode contemplated for carrying out the invention, various modifications are contemplated. For example, the stack 20 could comprise a plurality of vertical layers of carpet strips 22 maintained in compression by front and rear bands 34, 34' merely by turning the illustrated target on its side. Although rectangular carpet strips are illustrated, the invention is not so limited and includes circular, elliptical and strips of other shapes.

As various modifications could be made in the constructions herein described and illustrated without departing from the scope of the invention, it is intended that all matter contained in the foregoing description or shown in the accompanying drawings shall be interpreted as illustrative rather than limiting.

I claim:

1. An archery target stop, comprising:

a flat base;

a stack of carpet strips placed upon the base; and at least one band wrapped around the stack tightly enough to maintain the stack under compression;

wherein the stack of carpet strips includes in alternating sequence strips of 20 ounce commercial grade carpet, strips of 40 ounce plush carpet, and strips of 60 ounce plush carpet, the carpet strips are rectangular, having a parallel pair of relatively long edges defining the front and rear faces of the stack, and a parallel pair of relatively short edges defining the left and right sides of the stack, and each band is wrapped around the top, left and right sides of the stack, and around the base; whereby, in use, an arrow shot at the stop will be caught between the strips of carpet.

2. The archery target stop of claim 1, wherein the band or bands are made of flexible, rustproof metal.

3. The archery target stop of claim 2, wherein the band or bands are made of flexible plastic.

4. The archery target stop of claim 3, further comprising a plurality of casters attached to the base for rolling the target stop from one location to another.

5. An archery target stop, comprising:

a stack of carpet strips; and at least one band wrapped around the stack tightly enough to maintain the stack under compression;

wherein the stack of carpet strips includes in alternating sequence strips of 20 ounce commercial grade carpet, strips of 40 ounce plush carpet, and strips of 60 ounce plush carpet, the carpet strips are rectangular, having a parallel pair of relatively long edges defining the front and rear faces of the stack, and a parallel pair of relatively short edges defining the left and right sides of the stack, and each band is wrapped around the top, left and right sides of the stack, whereby, in use, an arrow shot at the stop will be caught between the strips of carpet.

* * * * *